US005313733A

United States Patent [19]

Meade

[11] Patent Number: 5,313,733

[45] Date of Patent: May 24, 1994

[54] QUICK RELEASE SAFETY DEVICE FOR FIREARMS

[76] Inventor: Ronald A. Meade, Rte. 5, Box 756, Gloucester, Va. 23061

[21] Appl. No.: 967,374

[22] Filed: Oct. 28, 1992

[51] Int. Cl.[5] ..... F41A 17/00; F41A 35/02

[52] U.S. Cl. ..... 42/70.11; 42/96; 206/317

[58] Field of Search ..... 42/70.01, 70.07, 70.11, 42/96; 206/317; 224/911, 912

[56] References Cited

U.S. PATENT DOCUMENTS

| | | | |
|---|---|---|---|
| 290,867 | 12/1883 | Deyo | 42/70.08 |
| 521,533 | 6/1894 | Campbell | 42/70.08 |
| 835,349 | 11/1906 | Deming | 42/70.11 |
| 1,686,482 | 10/1928 | Windle | 42/70.07 |
| 2,545,428 | 3/1951 | Liautaud | 24/16 PB |
| 3,022,596 | 2/1962 | Cannon | 42/70.07 |
| 3,022,598 | 2/1962 | Wikstrom | 42/70.11 |
| 3,197,164 | 7/1965 | Hansen | 248/73 |
| 3,597,803 | 8/1971 | Van Neil | 24/16 |
| 3,720,014 | 3/1973 | Goodrich | 42/70.11 |
| 4,001,919 | 11/1977 | Moberg et al. | 24/16 |
| 4,235,356 | 11/1980 | Atchisson | 224/911 |
| 4,240,183 | 12/1980 | Sumimoto et al. | 24/16 |
| 4,392,318 | 7/1983 | Daniels | 42/70.11 |
| 4,395,837 | 8/1983 | Durnal | 42/70.11 |
| 4,398,367 | 8/1983 | Gamble et al. | 42/96 |
| 4,412,397 | 11/1983 | Bayn | 42/70.11 |
| 4,443,962 | 4/1984 | Bernet et al. | 42/70.11 |
| 4,477,950 | 10/1984 | Cisek et al. | 24/16 |
| 4,580,319 | 4/1986 | Paradis | 24/16 PB |
| 4,586,570 | 5/1986 | Swift | 24/16 |
| 4,912,867 | 4/1990 | Dukes | 42/70.11 |
| 4,934,083 | 6/1990 | Smith | 42/70.11 |
| 4,961,277 | 10/1990 | Rosenbaum | 42/70.11 |
| 5,099,596 | 3/1992 | Butler | 42/70.11 |

OTHER PUBLICATIONS

Smith et al, The Book of Rifles, 1948, pp. 590–591.

*Primary Examiner*—Stephen C. Bentley
*Attorney, Agent, or Firm*—Clyde I. Coughenour

[57] ABSTRACT

A combination cover and elongated friction device for holding the cover in position on a firearm is provided. The device can be used with different type guns. The cover is provided with holes and slots, for holding a bolt or hammer in a fixed position, and is shaped, to enclose the trigger or prevent movement of firearm parts, and has plural sized apertures to receive protrusion of the elongated friction device. The friction device has plural protrusions larger than the sized apertures to create an interference fit that requires specific force to remove so that there is a resistance to accidental discharge and use of the firearm by children.

20 Claims, 3 Drawing Sheets

FIG. 1
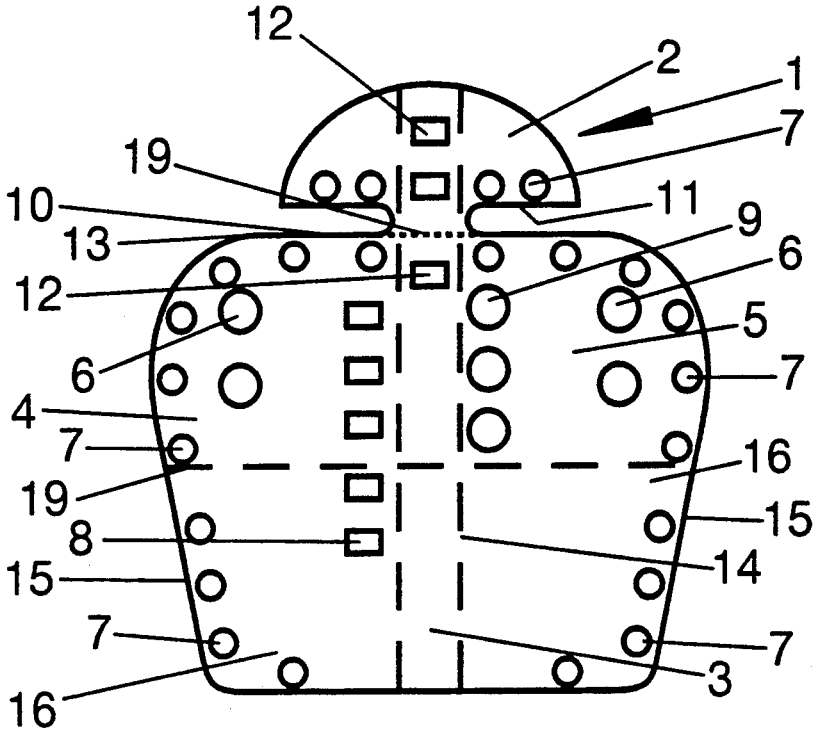
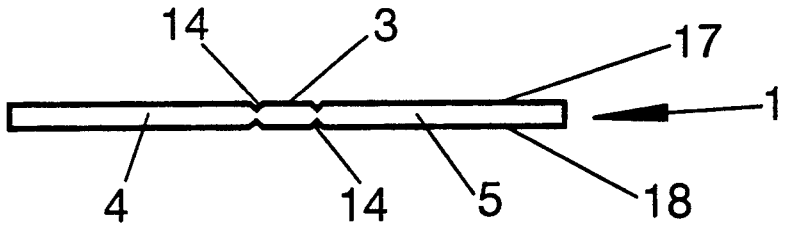
FIG. 2

QUICK RELEASE SAFETY DEVICE FOR FIREARMS

BACKGROUND OF THE INVENTION

1. Field of the Invention

The invention is to an externally attached friction operated safety system for firearms. A cover device is placed over the trigger and/or trigger guard and/or hammer or bolt of a firearm or between relatively movable parts. The cover is held in place by a friction means of either the reusable type or the nonreusable fracture type. Either type friction means requires a predetermined force to remove or break the frictional hold. The cover device is used to obstruct access to and/or prevent movement of operating parts of firearms.

2. Description of Related Art

Prevention of the accidental discharge of firearms has been of concern almost since the use of such arms began. Many contrivances have been built internally into and externally onto and both internally and externally of firearms as safety devices for controlling discharge. Some of these safety devices, especially the external type, are independent additions to build in safety means.

There are many devices that lock or secure portions of a firearm to prevent unauthorized use. Deming, U.S. Pat. No. 835,349 issued Nov. 6, 1906, and Bayn, U.S. Pat. No. 4,412,397 issued Nov. 1983, and Butler, U.S. Pat. No. 5,099,596 issued Mar. 31, 1992, are examples of securing firearm hammers using a padlock, frangible strap and quick release child resistant pressure responsive means. Windle, U.S. Pat. No. 1,686,482 issued Oct. 2, 1928, and Cannon, U.S. Pat. No. 3,022,596 issued Feb. 27, 1962, and Durnal, U.S. Pat. No. 4,395,837 issued Aug. 2, 1983, are examples of covering the trigger of a firearm. Bernet et al, U.S. Pat. No. 4,443,962 issued Apr. 24, 1984, teach a guard for the bolt of a firearm.

The use of a sized aperture and an elongated strip with protrusions for frictional force fit is old for permanent engagement, with Hansen, U.S. Pat. No. 3,197,164 issued Jul. 27, 1965 an example, as is insertion and removal for adjustment, with Liautaud, U.S. Pat. No. 2,545,428 issued Mar. 13, 1951 an example. Most fasteners and securing means are concerned with ease of insertion in one direction and a reverse direction force movement that will fracture and destroy the fastener or securing means; Van Neil, U.S. Pat. No. 3,597,803 issued Aug. 10, 1971, and Moberg et al, U.S. Pat. No. 4,001,919 issued Jan. 11, 1977, are examples.

SUMMARY OF THE INVENTION

Ignorance of the danger and improper handling of both the "loaded" and "unloaded" firearm frequently result in injury and death. Carelessly stored firearms often get into the hands of children. The present safety device can be used during storage and/or transport as a deterrent to careless and unauthorized use. The present invention is a simple inexpensive friction operated safety means that can be used with many different type firearms. The safety means helps to prevent accidental discharge of a firearm and acts as a deterrent to the unauthorized use of firearms by persons and in particular by children. A cover is provided that is flexible or has a hinge means so that it can be placed over the trigger, hammer, and/or bolt of a firearm, be it of the shoulder or hand held type. The cover is provided with various openings, such as slots and holes for accommodating moving parts of a firearm such as the fire arm hammer or bolt, and sized apertures, for passage of friction reusable or fracture straps or other type securing means. The friction or fracture straps or other securing means are normally released or removed easily by an adult, yet the securing means prevents or makes it extremely difficult for children to release or remove it.

BRIEF DESCRIPTION OF THE DRAWINGS

FIG. 1 is a top plan view of the cover of the present invention.

FIG. 2 is an end view of the cover of the present invention.

DETAILED DESCRIPTION OF THE PREFERRED EMBODIMENT

Figure 3:
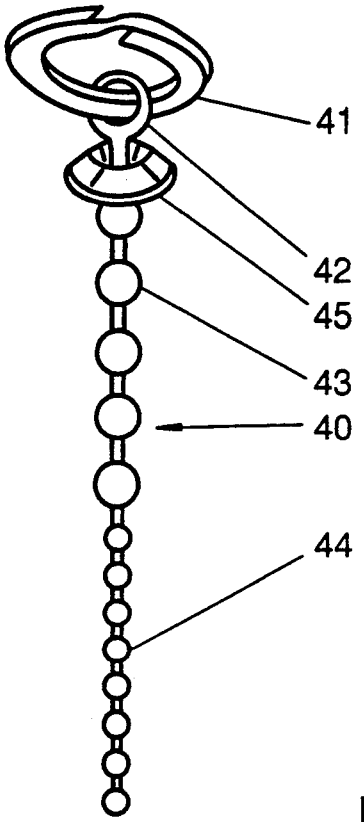
FIG. 3 is a side plan view of a preferred friction release securing device of the present invention.

In accordance with the present invention, a cover (1) is shown in FIGS. 1 and 2. The cover can take on any convenient shape and is shown being generally triangular with modified corners. The cover can be anywhere from fairly resilient to rigid and made of various materials such as metals and plastics. The preferred material is a semi-rigid plastic, about ⅛ inch thick. A hinge means, shown as an area of reduced thickness (14), on both sides (17,18) of cover (I), is provided for rigid and semi-rigid materials. The hinge means can be limited to a recess on only one side of the cover, if desired. The cover has a central portion (3) with a first side portion (4) and a second side portion (5). The cover is provided with openings for reception of firearm parts. The central portion of the cover is provided with one or more slots (12) to accommodate a firearm hammer. To one first side (4) or the other second side (5) of the cover central portion (3) openings, such as circular holes (9) and/or rectangular holes (8), are provided to accommodate bolts such as the cylindrical and rectangular (71) bolts used in automatic and semi-automatic weapons. If desired, the type holes provided may be varied and alternated on one or both sides (4,5). It would be an advantage to have the holes alternate on one side if the areas of reduced thickness (14) were on one side only with bending limited to one direction.

Around the periphery (15) of the cover, sized apertures (7) are provided. Additional sized apertures (7) and one or more sized passages (6) are provided between the central portion (3) and the periphery (15) of the cover. The sized passages (6) can be used with a locking means, such as a key operated padlock (85) with the shank (84) of the size to frictionally engage passages (6) similar to that between the devices of FIGS. 3-5 and sized apertures (7). Alternatively, the shank (84) can be smaller than the passage (6), to secure in the standard way. Eyelets can be provided to protect the passages if desired. The sized apertures (7) can be used with reusable friction means (40 or 50) or fracture means or other securing means such as the fastening, tie, security seal, closure, and locking devices in common use.

A cover extension (2), that can take any desired shape, is shown generally semi-circular in FIG. 1. It is provided with sized apertures (7) along one edge (11), essentially the same as the apertures (7) of the cover (1), and one or more slots (12) along its central area. The cover extension (2) can be separate and secured to the cover using the sized apertures (7) in the cover and the cover extension. It is preferred that cover extension (2) be integral with and attached to the central portion (3) of the cover. A cover extension attachment means can extend between the cover central portion (3) and cover extension (2) as shown in FIG. 1. A recess (10) of any desired shape is provided on either side of the central portion so that the cover extension (2) can be bent about a line of weakness (19). When the cover sides (4,5) are bent perpendicular to the cover central portion (3) and the cover extension (2) is bent toward the cover sides, the sized apertures (7) in the cover extension inner edge (11) and cover inner edge (13) can be secured together using any fastening means. This can be seen in FIG. 8 with a fastener (20) positioning the cover extension (2) to the cover (1) body. With the cover extension in place, the hammer of firearms can be secured in the uncocked position.

If the cover is to be used with one specific firearm, the sized apertures (7) around the periphery (15) can be used with multiple securing means, such as rivets or elongated fracture means, or with a single securing means, such as rawhide or wire, to shape the cover to fit over the specific firearm. When secured in this manner, the firearm can easily be slipped into and out of the cover and the friction securing device attached and removed quickly and easily by the user. More than one friction device may be necessary to hold the cover on some firearms. This can be seen in FIG. 8 where fasteners (20) are used to position the cover sides (4,5) so that the hand gun (90) can be slipped in and a securing means (40) and/or (20) used to secure the cover sides and/or cover extension (2) in place.

FIG. 3 shows one preferred friction securing means (40). An enlarged grip means, shown as a ring (41), is fixed to one end of a bead chain by a connector (42). The end pull beads (44) on the first end of the chain, furthest from the ring (41), are formed smaller than the diameter of the sized apertures (7) so they can be easily threaded through the sized apertures. The intermediate beads (43) form friction protrusions. They are placed between the end pull beads and ring and are formed larger than the sized apertures so that a force is required to temporarily expand the diameter of the sized aperture and/or temporarily deform or reduce the diameter of the intermediate beads. To control the force necessary to temporarily expand the sized aperture or deform or reduce the diameter of the intermediate beads, the interference between the two can be controlled and/or the materials or resilience of the materials of the two can be controlled and/or the specific shape of the two can be controlled. A stop (45) can be provided to limit the amount of chain pulled through the sized aperture.

Figure 4:
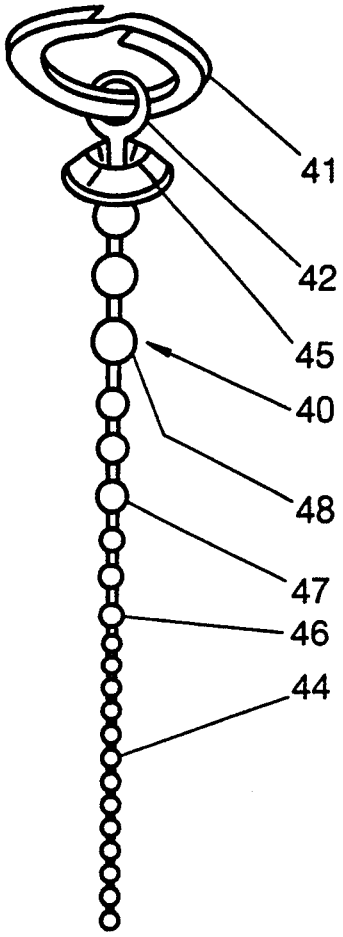
FIG. 4 is a side plan view of a modification of the friction release securing device of FIG. 3.

The force necessary to remove the securing means can optionally be left to the use by providing gradually increasing diameter beads. The beads can have either individually increasing diameters or any desired numerical series of beads (46,47,48) can have the same diameter with adjacent series having increased diameters as shown in FIG. 4. The beads 44 are smaller than beads 46 and beads 46 are smaller than beads 47 and beads 47 are smaller than beads 48.

The friction device is used by threading the smaller end pull beads (44) through the sized apertures (7) and using the smaller end pull beads to pull the larger intermediate beads through the sized apertures. The same or a different diameter bead can be threaded through the sized openings on either side portion of the cover. Two beads on alternate sides may add to the force necessary to remove the fastener. The force necessary to remove the securing means is preferably between 25 and 100 pounds. To remove the friction means, the ring (41) is used to pull the beads back through the sized apertures in the reverse direction.

With the preferred material for the beads a metal, and no provisions made for bending, the preferred material for the cover is a plastic. With the preferred material for the cover a metal, the preferred material for the friction device is a plastic. Both the beads and cover can be of the same material.

Figure 5:
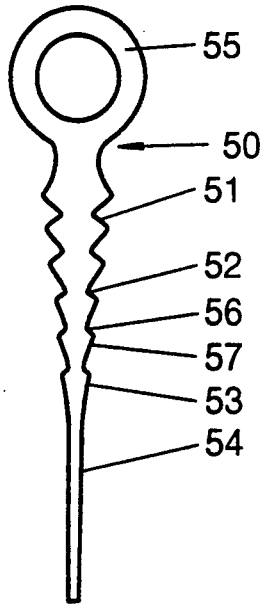
FIG. 5 is a side plan view of an alternative friction release securing device to that shown in FIG. 4.

FIG. 5 shows a plastic friction device (50) similar to the chain bead friction device (40) of FIG. 4. The friction device (50) is preferably made of a single or integral piece of plastic having a finger ring (55) with an elongated extension (54) having thereon friction protrusions or extensions (51,52,53). As with the beads (46,47,48) of the chain friction device (40), the friction extensions (51,52,53) are progressively smaller as they extend from the finger ring to permit the user to select the force necessary to insert and remove the friction device. By shaping the protrusions, the pull necessary to thread the friction device through the sized apertures and the pull necessary to remove the friction device from the sized apertures can be made different. This can be done, for example, by providing a step or by a steeper angle (56) on one side of the protrusion than on the other (57).

Figure 6:
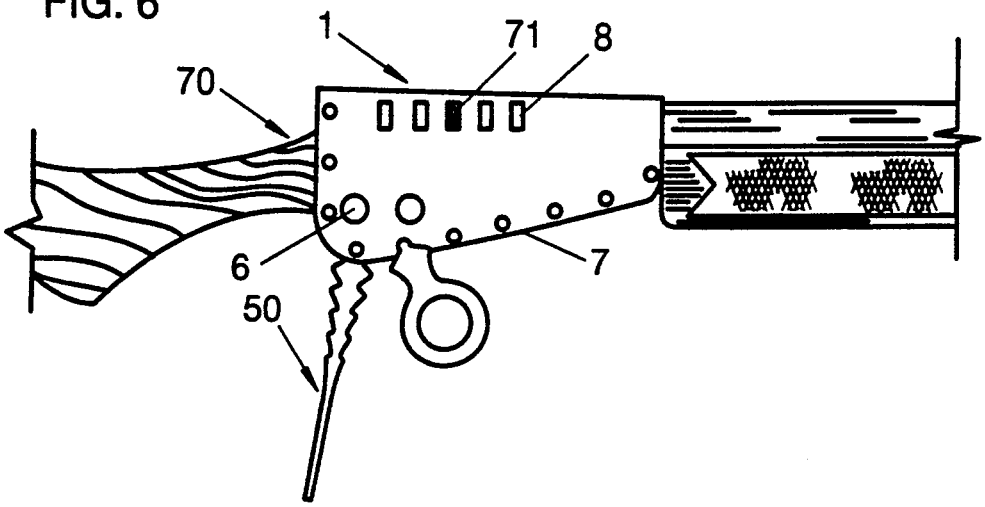
FIG. 6 is a side elevational view of the cover shown in place on a bolt action rifle with the cover extension removed.
Figure 7:
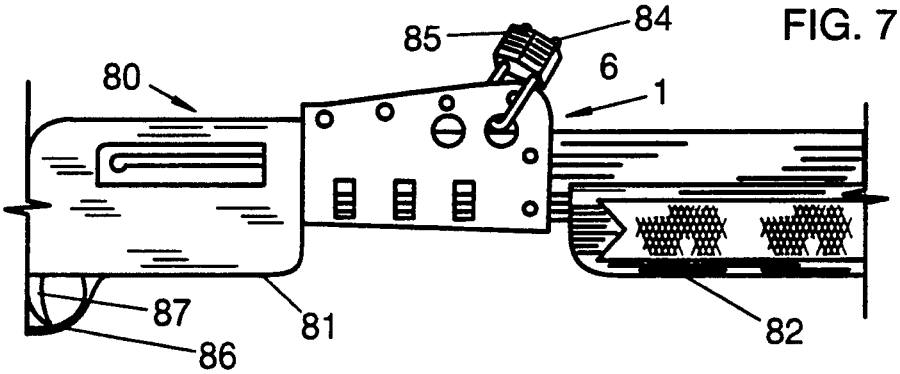
FIG. 7 is a side elevational view of the cover, with the cover extension and a section removed, shown in place on a pump action shotgun.
Figure 8:
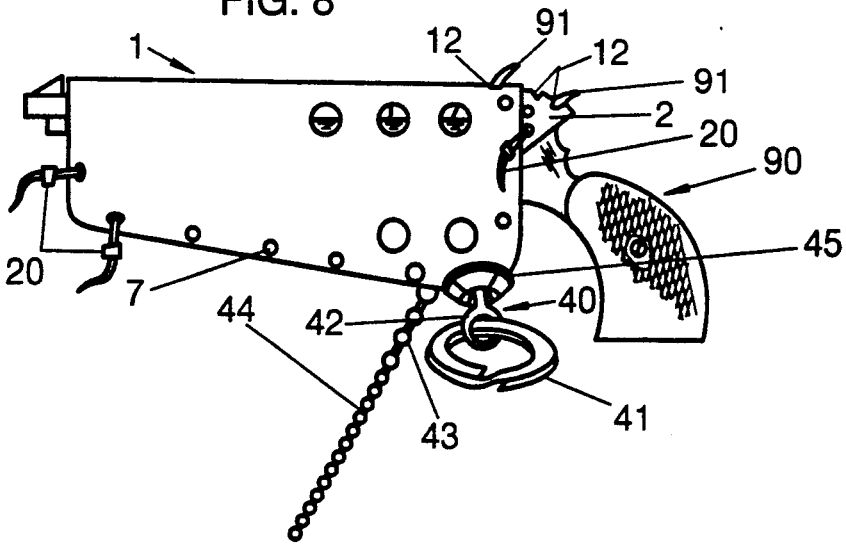
FIG. 8 is a side elevational view of the cover shown in place on a pistol.

The cover of the present invention can be secured onto most fire arms now in use. Examples of various applications of the cover are shown in FIGS. 6–8. FIG. 6 is an example of the cover being used with a slide bolt action rifle (70). As can be seen, the cover extension (2) has been removed by cutting along the line of weakness (19) in the extension attachment means, and the cover secures the bolt (71) in position in a rectangular hole (8) while covering and concealing the trigger. The bolt (71) can be held in either the open or closed position. While any of the various securing means can be used, a friction device (50) is shown holding the cover in position. The rectangular hole (8) is placed over the bolt (71) by placing the central portion of one side (17) of the cover in contact with the rifle and bending the sides down over the rifle. If the bolt is cylindrical, the other side (18) of the cover (1) is placed against the firearm to align circular holes (9) with the bolt.

FIG. 7 is an example of a pump action gun, shown as a shotgun (80), with the standard trigger (87) and trigger guard (86). The cover can be provided with one or more lines of weakness (19) perpendicular to the cover central portion (3) so that the cover can be easily severed. The cover, with the cover extension (2) and one end (16) cut away or removed, by cutting along the lines of weakness (19) is secured between the pump hand grip (82) and the breech (81). When the line of weakness (19) through the cover central portion and first side and second side is cut, outer edges are formed parallel to inner edges (13). While any of the securing means may be used to secure the cover (1) in position on the gun, a padlock (85) is shown holding the cover in position. The cover blocks movement of the pump hand grip.

FIG. 8 is an example of the cover used on a hand gun (90). As can be seen, the hammer (91) is secured in the uncocked position and the trigger is covered and concealed. The hammer is also shown in broken lines depicting how it would look on firearms with a lower mounted hammer in the cover extension (2). Fracture type securing means (20) are shown holding the cover first side (4) and second side (5) in a fixed position and the cover extension inner edge (11) in place against the cover inner edge (13). The hand gun can be placed in the cover and removed from the cover without disturbing the fracture securing means (20). A frictional reusable release means (40) is shown securing the cover onto the revolver (90). The cover extension (2) can be retained on the cover (1) for holding the hammer in the down position or removed along a line of weakness (19), as desired.

It is believed that the construction, operation and advantages of this device will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

I claim:

1. An externally attached cover in combination with a friction release device for forming a safety device for firearms comprising:

a shaped essentially flat cover having a central section and a first side and a second side capable of being bent from said central section such that said first side and said second side can be positioned essentially parallel to each other;

a frictionally operated release device;

said frictionally operated release device having an elongated carrier means with a first end and a second end and a series of friction protrusions extending from said elongated carrier means between said first end and said second end;

both said first side and said second side of said cover being provided with a sized aperture for reception of said protrusions of said frictionally operated securing device;

said friction protrusions extending from said elongated carrier being sized and shaped to be larger than said sized apertures in said cover first side and second side to create an interference fit;

the materials of said cover and said protrusions and the shape of said protrusions and said sized apertures and the amount of interference between said protrusions and said sized apertures being selected so as to require a predetermined force to engage and disengage said frictionally operated release device into and from said cover sized apertures.

2. The externally attached cover as set forth in claim 1 wherein:

said protrusions are shaped so that the force required to remove them from said sized aperture is greater than that required to engage them.

3. The externally attached cover as set forth in claim 1 wherein:

said cover is provided with slots in said central portion, for positioning the hammer of a firearm, and with rectangular holes adjacent said central portion in said first side and with circular holes adjacent said central portion in said second side, for positioning the bolt of a firearm, and with sized passages in said first side and in said second side for passage of a securing means.

4. The externally attached cover as set forth in claim 1 wherein:

said protrusions are of different sizes and are grouped in series of progressively larger protrusions progressing from said first end to said second end of said elongated carrier so that the force necessary to remove said friction release device can be controlled by the user of the device.

5. The externally attached cover as set forth in claim 1 wherein:

said cover is provided with sized apertures around the periphery thereof for reception of securing means that can position said cover first side and second side with respect to one another for insertion and removal of a firearm for easier and quicker use with said frictionally operated release device.

6. The externally attached cover as set forth in claim 1 wherein:

said cover is provided with a shaped cover extension;

said shaped cover extension having sized apertures along one edge thereof;

a slot in a central area of said shaped cover extension for positioning the hammer of a firearm.

7. An externally attached safety device for use with a frictionally operated securing device for firearms comprising:

an essentially flat shaped cover having an elongated central portion and a first side and a second side extending from said elongated central portion;

means associated with said cover first side and second side and central portion so that said cover first side and second side are capable of being bent from said central portion such that said first side and said second side are essentially parallel to each other;

said cover being shaped and provided with a plurality of opening means adjacent said cover central portion on said cover first side for receiving parts of said firearms for preventing access to and for preventing movement of said firearm parts;

both said first side and said second side of said cover additionally being provided with a plurality of spaced sized aperture means remote from said cover central portion and spaced from each other for passage of said frictionally operated securing device and for reception of protrusions on said frictionally operated securing device for releasably holding said cover in place on various types and shapes of said firearms and for preventing movement of a variety of said firearm parts while said cover is secured in place on said firearm.

8. The externally attached safety device as set forth in claim 7 wherein:

said cover opening means include holes in said first side and said second side adjacent said central portion with said holes in said first side being rectangular for reception of a firearm rectangular bolt and said holes in said second side being circular for reception of a firearm cylindrical bolt and said central portion being provided with a slot for reception of a firearm hammer.

9. The externally attached safety device as set forth in claim 8 wherein:

said cover is semi-rigid and said means associated with said cover firs side and second side so that they are capable of being bent is a hinge means between said first side and said central portion and between said second side and said central portion to provide for said bending.

10. The externally attached safety device as set forth in claim 7 wherein:

said cover is provided with a shaped cover extension;

said shaped cover extension has sized apertures along one edge thereof;

a slot is in a central area of said shaped cover extension for positioning a hammer of said firearm.

11. The externally attached safety device as set forth in claim 10 wherein:

a cover extension attachment means extends between said cover central portion and said shaped cover extension;

said cover extension attachment means has a line of weakness formed therein to provide a means for bending or a guide and easy separation means for removing said cover extension.

12. The externally attached safety device as set forth in claim 7 wherein:

said cover first side and second side and central portion have a line of weakness extending therethrough to provide a guide and easy separation means for removing a portion of said cover.

13. An externally attached safety device for use with a frictionally operated securing device for firearms comprising:

an essentially flat shaped cover having a central portion and a first side and a second side;

means associated with said first side and said second side so that they are capable of being bent from said central portion such that said first side and said second side are essentially parallel to each other;

said cover being shaped to provide an opening for receiving parts of said firearms for preventing movement of said firearm parts;

both said firs side and said second side of said cover having sized apertures for passage of said frictionally operated securing device and for reception of protrusions on said frictionally operated securing device for releasably holding said cover in place on said firearms;

said cover being provided with a shaped cover extension;

said shaped cover extension having sized apertures along one edge thereof;

a slot in a central area of said shaped cover extension for positioning a hammer of said firearm.

14. The externally attached safety device as set forth in claim 13 wherein:

a cover extension attachment means extends between said cover central portion and said shaped cover extension;

said cover extension attachment means has a line of weakness formed therein to provide a means for bending or a guide and easy separation means for removing said cover extension.

15. The externally attached safety device as set forth in claim 13 wherein:

said cover first side and second side and central portion has a line of weakness extending therethrough to provide a guide and easy separation means for removing a portion of said cover.

16. The externally attached safety device as set forth in claim 13 wherein:

said cover first side and second side has inner edges adjacent said cover extension one edge;

said cover first side and second side inner edges are provided with sized apertures corresponding to said sized apertures along said one edge of said shaped cover extension for reception of securing means to position said shaped cover extension at an angle with respect to said cover central portion.

17. An externally attached safety device for use with a securing device for firearms comprising:

an essentially flat shaped cover having a central portion and a first side and a second side:

said cover being semi-rigid and said cover being provided with hinge means between said first side and said central portion and between said second side and said central portion to provide for bending;

said cover being shaped for receiving parts of said firearms for preventing movement of said firearm parts;

said cover first side and second side having means forming inner edges that extend essentially perpendicular to said cover central portion;

said cover first side and second side having means for forming outer edges that extend essentially perpendicular to said cover central portion and essentially parallel to said cover first side and second side inner edges;

both said first side and said second side of said cover having sized passages for passage of said securing device;

said sized passages in said cover first side and second side being spaced from said cover central portion a distance sufficient to permit a firearm portion to be placed there-in-between so that said securing device can be passed through said passage in said cover first side and said passage in said cover second side without interference form said firearm portion placed between said cover first and second sides;

said cover central portion and said cover first side and second side inner edges and means for forming outer edges being spaced from each other a distance sufficient to permit said cover central portion and said cover between said inner edges and said outer edges to be placed between a firearm pump hand grip and breech when spaced apart in a firing position but said distance between said inner edges and said outer edges being insufficient to fit between said firearm pump hand grip and breech in an unextended loading position so that when said cover is placed between said firearm pump hand grip and breech in the firing position and said securing device is inserted, said cover prevents said pump hand grip from being operated to load said firearm.

18. The externally attached safety device as described in claim 7 wherein:

said means for forming outer edges is a line of weakness formed in said cover to provide a guide and easy separation means for removing a portion of said cover.

19. The externally attached safety device as described in claim 17 wherein:

said cover central portion has a cover extension attachment means adjacent said cover inner edges of said cover first side and second side;

a cover extension is attached to said cover extension attachment means.

20. The externally attached safety device as described in claim 19 wherein:

said cover extension attachment means has a line of weakness formed therein to provide a means for bending or a guide and easy separation means for removing said cover extension.

* * * * *